United States Patent [19]

Cuiper

[11] Patent Number: 4,681,166

[45] Date of Patent: Jul. 21, 1987

[54] INTERNAL NONROTATING TIE-BACK CONNECTOR

[75] Inventor: Glen H. Cuiper, Spring, Tex.

[73] Assignee: Hughes Tool Company, Houston, Tex.

[21] Appl. No.: 897,431

[22] Filed: Aug. 18, 1986

[51] Int. Cl.[4] ..... E21B 33/038

[52] U.S. Cl. ..... 166/345; 166/217; 166/237; 166/359; 285/18; 285/141; 285/392

[58] Field of Search ..... 166/344, 345, 341, 359, 166/380, 115, 206, 207, 217, 237; 285/392, 140, 18, 141

[56] References Cited

U.S. PATENT DOCUMENTS

| | | | |
|---|---|---|---|
| 2,737,247 | 3/1956 | Baker | 166/217 |
| 2,849,245 | 8/1958 | Baker | 285/141 |
| 3,420,308 | 1/1969 | Putch | 166/208 |
| 3,741,589 | 6/1973 | Herd, et al. | 285/3 |
| 3,893,717 | 7/1975 | Nelson | 285/3 |
| 4,167,970 | 9/1979 | Cowan | 166/208 |
| 4,363,558 | 12/1982 | Ellis | 166/217 X |
| 4,391,326 | 7/1983 | Greenlee | 166/217 X |
| 4,465,134 | 8/1984 | Watkins | 166/245 |
| 4,513,822 | 4/1985 | Gilbert | 166/217 X |
| 4,528,738 | 7/1985 | Galle, Jr. | 29/416 |
| 4,607,865 | 8/1986 | Hughes | 285/18 |

*Primary Examiner*—James A. Leppink
*Assistant Examiner*—Hoang C. Dang
*Attorney, Agent, or Firm*—James E. Bradley

[57] ABSTRACT

A tie-back connector for a subsea well allows the tie-back connection to be made without rotation. A set of threads is located on an inner wall of the outer conduit into which the tie-back connection is to be made. An annular latch is carried by the inner conduit which is being tied back from the surface to the outer conduit. The latch has threads on its exterior which ratchet past the threads on the inner wall as the inner conduit is lowered into the outer conduit. After the threads of the latch are ratcheted fully into alignment with the threads in the outer conduit, the inner conduit is pulled upwardly relative to the latch to secure it in tension. A retainer is actuated when the inner conduit is in the upper position to prevent the inner conduit from moving downwardly again relative to the latch. The inner conduit can be removed by rotation relative to the outer conduit.

3 Claims, 10 Drawing Figures

INTERNAL NONROTATING TIE-BACK CONNECTOR

CROSS-REFERENCE TO RELATED APPLICATION

This application is being filed simulataneously with an application by the same inventor which contains some common subject matter and which is entitled EXTERNAL TIE-BACK CONNECTOR filed Aug. 18, 1986, Ser. No. 897,567.

BACKGROUND OF THE INVENTION

1. Field of the Invention

This invention relates in general to subsea well completion equipment, and in particular to a tie-back connection apparatus for a subsea well.

2. Description of the Prior Art

One manner of completing a subsea well is to place the Christmas Tree at the subsea floor. Valves and controls will be associated with the Christmas Tree for controlling the flow of oil. The flow of oil will flow through a production riser to a production platform at the surface for treatment. The processed oil then is pumped down to a pipeline which leads to a gathering station.

A subsea Christmas Tree and its controls will be considerably more expensive than a Christmas Tree located above the surface of the water. Because of this, sometimes tie-back connections are used. With a tie-back, connection, conduit is connected into the wellhead housing at the subsea floor to extend to the surface. The conduit is capable of withstanding the well pressure, and is basically an extension of the well. The Christmas Tree will be mounted at the top of the conduit at the surface. The conduit will be supported in tension by a floating production vessel.

Tie-back connection devices are available. In some, it is necessary to rotate the conduit being stabbed into the subsea wellhead housing. This results in threading difficulties. In other cases, extensive running tools are necessary to actuate the locking of the upper conduit to the lower conduit.

SUMMARY OF THE INVENTION

This invention deals specifically with a tie-back connector that locates inside the wellhead housing and extends to the surface. The tie-back connector includes a set of threads formed on the inner wall of the outer conduit, such as the wellhead housing. An annular latch is carried by the inner conduit. This latch also has a set of threads which engage the threads in the outer conduit. When inserting the inner conduit into the outer conduit, there is no rotation. Rather, the latch threads deflect inwardly to slide or ratchet past the threads of the outer conduit. When pulling upward, the threads lock together to allow tension to be pulled on the connection.

A retainer is connected between the latch and the inner conduit. This retainer actuates to prevent the inner conduit from lowering back again relative to the latch after the latch has already engaged the threads of the outer conduit. By rotating the inner conduit, one may remove the inner conduit from the outer conduit, with the threads unscrewing from each other.

DESCRIPTION OF THE PREFERRED EMBODIMENT

Figure 8:
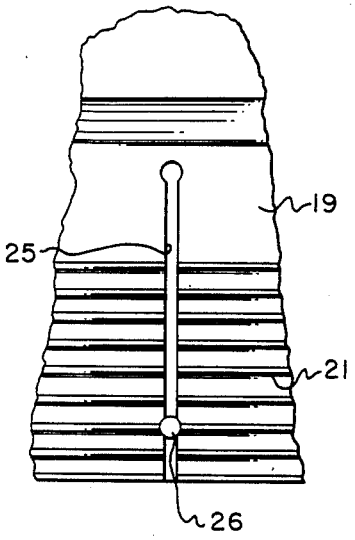
FIG. 8 is a side view of a portion of the latch shown in FIG. 6.
Figure 9:
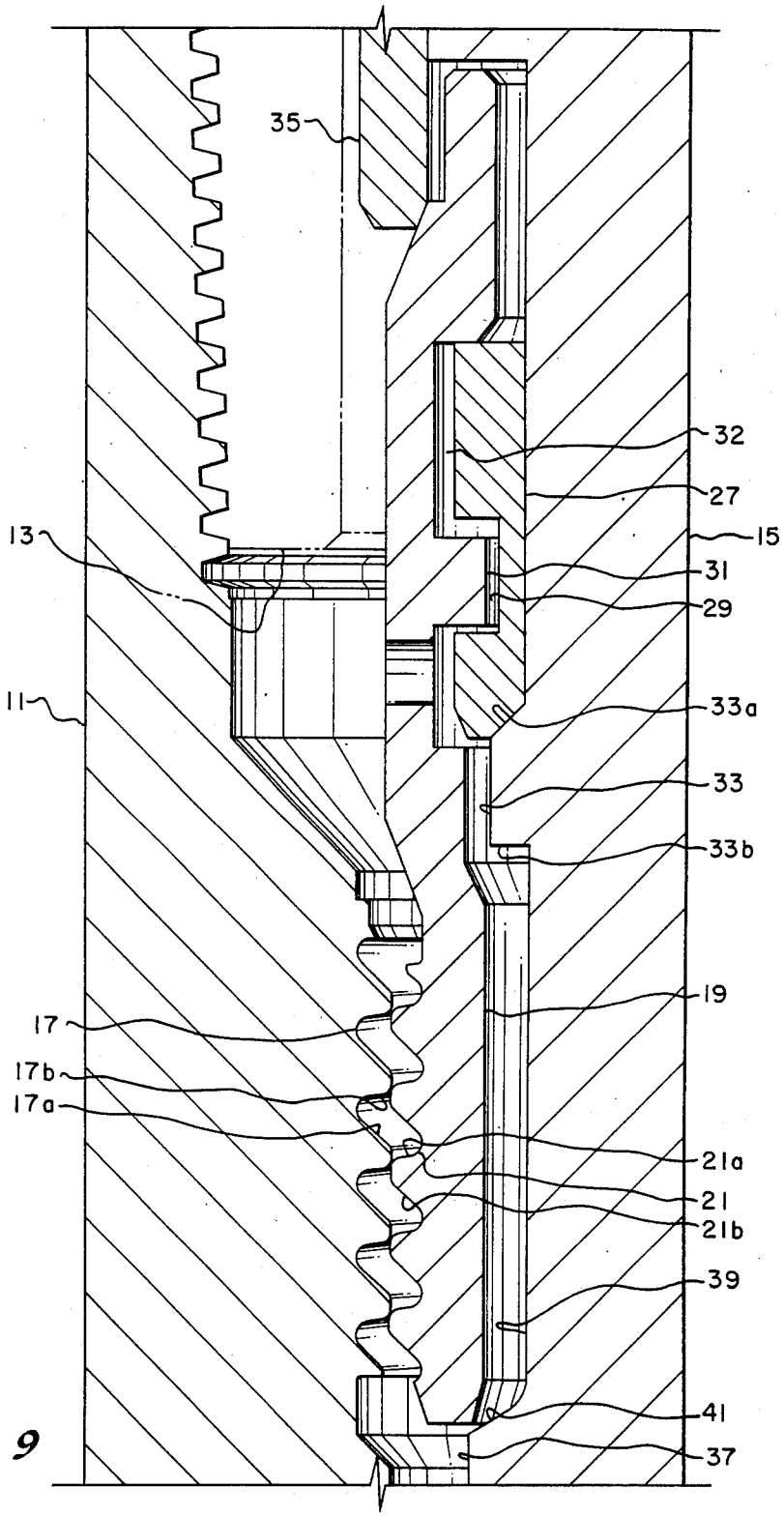
FIG. 9 is an enlarged partial view of the tie-back connection apparatus as illustrated in FIG. 2.

FIGS. 2–9 show in general a tie-back connection apparatus. FIG. 1 shows such an apparatus being used with a specific subsea well assembly. Referring to FIG. 9, the outer conduit 11 will extend to the surface through a threaded connection with an upper conduit 13, shown with dotted lines. The inner conduit 15 is lowered through the upper conduit 13 into engagement with the outer conduit 11, then pulled in tension.

The outer conduit 11 has a set of threads 17 located on its inner wall. Threads 17 are of a rounded stub buttress type, which has a rounded saw toothed configuration. The upper flank 17*a* inclines downwardly at about a 45 degree angle relative to the axis of the outer conduit 11. The lower flank 17*b* inclines slightly upward at an angle of about 7 degrees relative to a plane perpendicular to the axis of the outer conduit 11.

An annular latch 19 is used to secure the inner conduit 15 to the outer conduit 11. Latch 19 has a plurality of threads 21 which are adapted to engage the threads 17. Threads 21 have the same pitch and have a configuration to mate with the threads 17. The upper flank 21*a* inclines slightly upward for bearing against the lower flank 17*b*. The lower flank 21*b* is inclined downwardly at about a 45 degree angle for locating in contact with the upper flank 17*a*. In FIG. 9, the threads 17 and 21 are not yet in locking engagement with each other, rather are shown in a position that occurs while the inner conduit 15 is lowered into the outer conduit 11.

Figure 6:
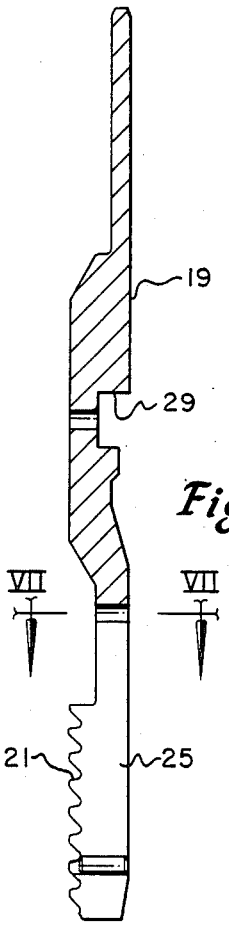
FIG. 6 is a cross-sectional view of the latch used with the tie-back connection apparatus illustrated in FIGS. 1*a* and 1*b*.
Figure 7:
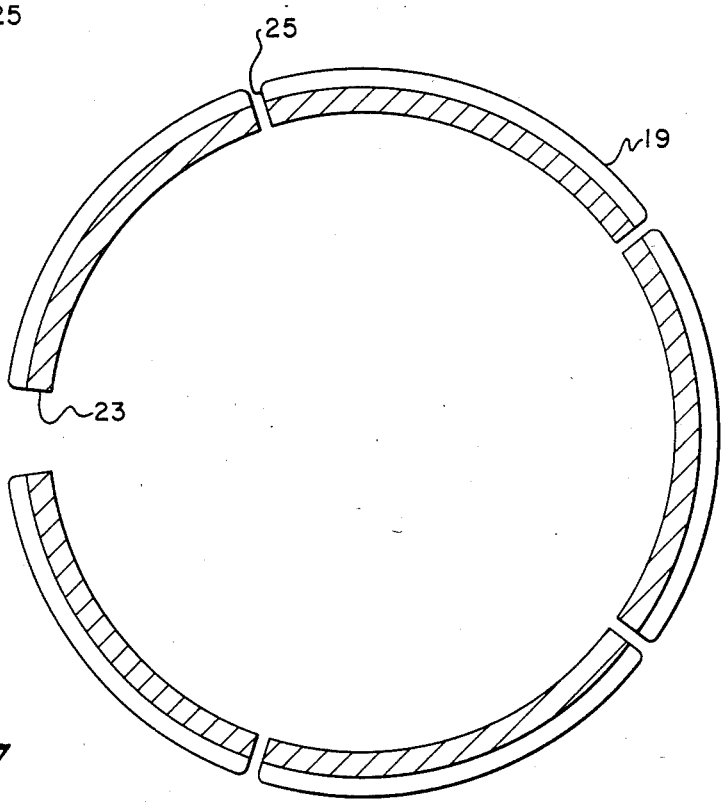
FIG. 7 is a cross-sectional view of the latch shown in FIG. 6, taken along the line VII—VII.

Referring to FIGS. 6–8, the latch 19 is a split ring. it has a vertical split 23 extending completely through the sidewall. Also, there are a plurality of slots 25 spaced around the sidewall of the latch 19. Slots 25 extend upwardly past the threads 21, but not the full length. A pin 26 is located in each slot 25 near the bottom. Pin 26 is welded to one side of the slot 25.

Figure 3:
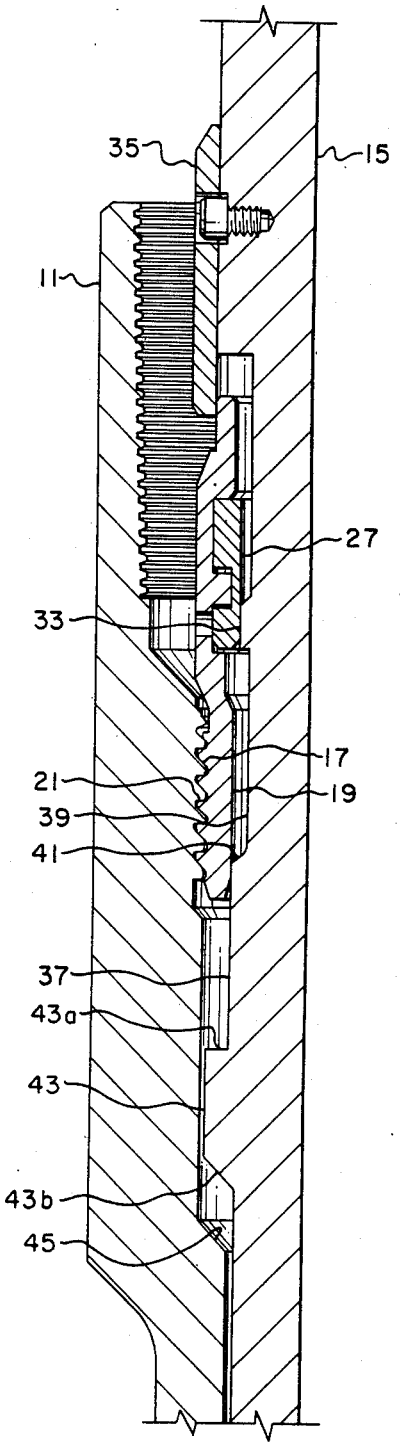
FIG. 3 is a view of the tie-back connection apparatus as illustrated in FIG. 2, but showing the threads of the tie-back connection apparatus engaged.

Pin 26 helps the latch 19 threads 21 retain shape when the latch 19 is unscrewed from threads 17. The split 23 and slots 25 allow the threads 21 of latch 19 to flex inwardly and ratchet past the threads 17 as the inner conduit 15 is lowered into the outer conduit 11. In the position shown in FIG. 9, the threads 21 are flexed back from the normal diameter. In the normal diameter, the threads 21 would fully engage the threads 17, as shown in FIG. 3. Referring again to FIG. 9, once the inner conduit 15 has moved downward a short distance from that shown in FIG. 9, the threads 21 will flex radially outward to engage the threads 17.

Referring still to FIG. 9, a retainer ring 27 retains the latch 19 on the inner conduit 15. Retainer ring 27 is a split ring which allows the retainer ring 27 to be expanded radially. Retainer ring 27 has an annular groove 29 that extends horizontally around the ring 27 perpendicular to the axis of the inner conduit 15. Groove 29 receives an annular flange 31 located in the inner wall of the retainer ring 27. The retainer ring 27 has a smaller outer diameter than the inner diameter of the latch 19, resulting in a clearance 32 located between them. The clearance 32 varies during installation, depending upon the expansion of retainer ring 27 and the compression of the latch 19.

An upper stop member 33 is formed on the outer wall of the inner conduit 15. Upper stop member 33 has an upper shoulder **33*a* that contacts the lower end of the retainer ring 27 while the inner conduit 15 is in the lower position relative to latch 19 as shown in FIG. 9. The upper shoulder 33*a* is frusto-conical. Upper stop member 33 has a lower shoulder 33*b* that faces downwardly and is perpendicular to the axis of the inner conduit 15. The radial thickness of the upper stop member 33 is no greater than the clearance 32 that exists when the latch 19 is in its uncompressed, natural state. This enables the retainer ring 27 to expand outwardly into the clearance 32 as the inner conduit 15 is pulled upwardly while the latch 19 is engaged with the threads 17**.

An annular collar 35 is bolted to the outer wall of the inner conduit 15 for engaging the upper portion of the latch 19 to hold it in place while the inner conduit 15 is lowered into the well. A cam surface 37 is formed on the outer wall of the inner conduit 15 a selected distance below the upper stop member 33. The cam surface 37 is a cylindrical surface which protrudes inwardly, resulting in an annular recess 39 that extends upwardly between it and the upper stop member 33. An upwardly facing frusto-conical shoulder 41 is located at the junction of the cam surface 37 with the recess 39. When the inner conduit 15 is in the lower position relative to latch 19 as shown in FIG. 9, the shoulder 41 will be in contact with the lower end of the latch 19.

Figure 2:
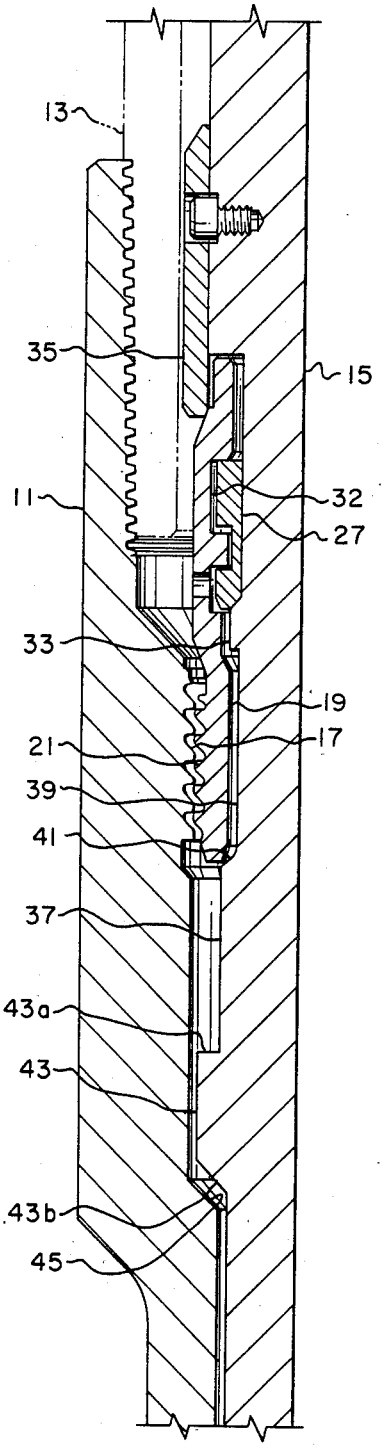
FIG. 2 is an enlarged partial cross-sectional view illustrating an inner conduit being lowered into an outer conduit and having the tie-back connection apparatus of FIGS. 1*a* and 1*b*.

Referring now to FIG. 2, a lower stop member 43 is located a distance below the cam surface 37. Lower stop member 43 is an annular member formed on the outer wall of inner conduit 15 and which protrudes outwardly from the cam surface 37. This results in an upper shoulder **43*a* that is perpendicular to the axis of inner conduit 15. A lower shoulder 43*b* is frusto-conical and faces downwardly. The lower shoulder 43*b* is adapted to engage a frusto-conical upwardly facing shoulder 45 located in an inner wall of the outer conduit 11**.

In operation, the outer conduit 11 will be in place initially. Then the inner conduit 15 is lowered without rotation through the upper conduit 13 and into the outer conduit 11. The inner conduit 15 will be initially located in the lower position relative to the latch 19, as shown in FIGS. 2 and 9. When the threads 21 of the latch 19 first began to contact the threads 17 of the outer conduit 11, inward deflection of the threads 21 will occur. Ratcheting action occurs, with the threads 21 moving inward and outward radially as they slide over the threads 17.

Referring to FIG. 2, when the shoulder **43*b* contacts the shoulder 45, the threads 21 will be fully latched into the threads 17, expanded outward to the normal uncontracted position. The operator at the surface then beings picking up the inner conduit 15. Because of the engagement of the threads 17 and 21, the latch 19 cannot move upward. The cam surface 37 will move inwardly of the latch 19 during this upward movement, as shown in FIG. 3. The positioning of the cam surface 37 inwardly of the latch 19 prevents the latch 19 from contracting so as to disengage the threads 21 from the threads 17. The recess 39 and the cam surface 37 thus serve as cam means for allowing deflection to occur while the inner conduit is in the lower position shown in FIG. 2, but preventing its occurrence when the inner conduit is moved to the upper position shown in FIG. 4**.

Figure 4:
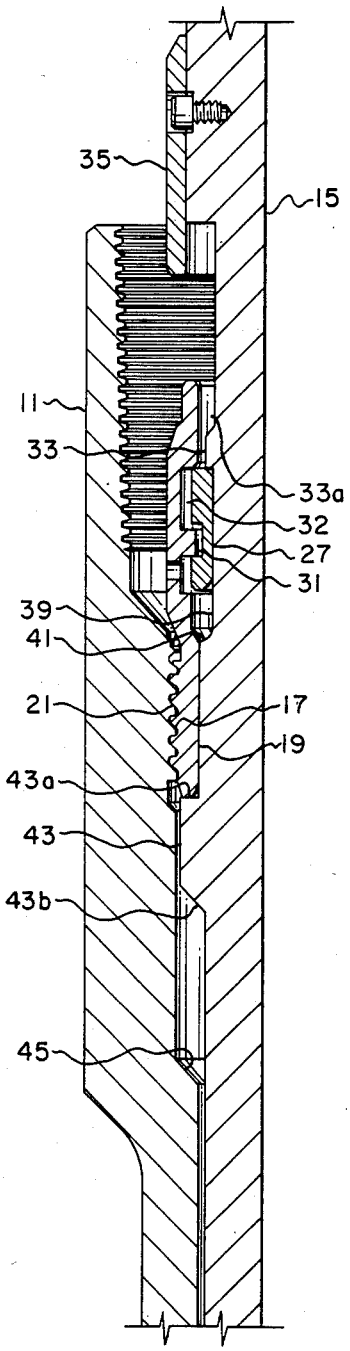
FIG. 4 is a cross-sectional view of the tie-back connection apparatus as illustrated in FIG. 2, but showing the inner conduit moved to the upper position, and the tie-back connection apparatus fully engaged.
Figure 5:
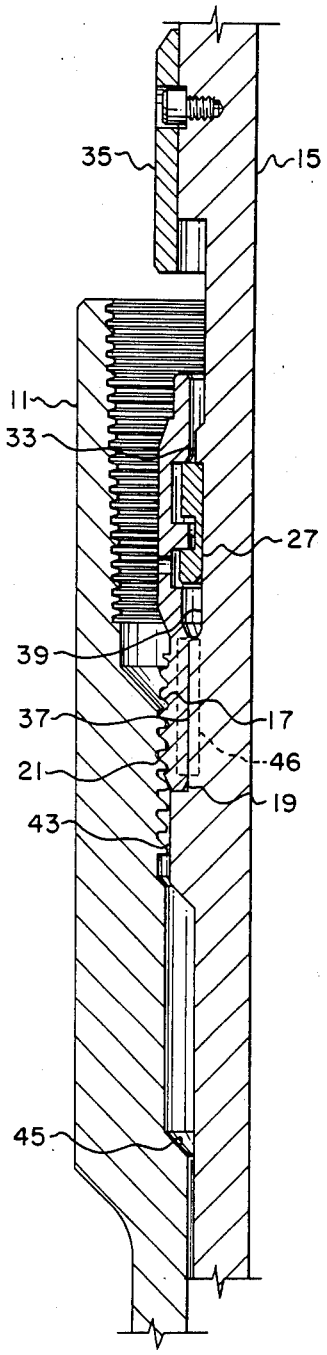
FIG. 5 is a cross-sectional view of the tie-back connection apparatus as illustrated in FIG. 2, but showing the inner conduit in the process of being unscrewed from the other conduit to remove the inner conduit.

Also, while moving to the upper position, as shown in FIG. 3, the upper stop member 33 will move behind the retainer ring 27, pushing it outwardly to close up the clearance 32. No outward force is exerted on the latch 19, however. When the full upper position is reached as shown in FIG. 4, the upper stop member 33 will locate immediately above the retainer ring 27, allowing it to contract back inwardly. The lower shoulder **33*b* (FIG. 9) contacts the upper edge of the retainer ring 27 in this position. The upper shoulder 43*a* contacts the lower edge of the latch 19. This prevents any further upward movement of the inner conduit 15**.

The upward force exerted on the inner conduit 15 is resisted by the load path through the lower stop member 43, latch 19 and threads 17. At the same time, if the tension is released at the surface, the inner conduit 15 cannot move downwardly. The weight of the inner conduit 15 would be transmitted through a load path through the upper stop member 33, retainer ring 27, annular flange 31, latch 19 and threads 21. The threads 21 resist the compressive force should tension be removed, because they cannot retract inwardly due to the positioning of the cam surface 37 inwardly of the threads 21.

Should it be necessary to remove the inner conduit 15 from the outer conduit 11, this can be readily accomplished. A key 46 (FIG. 5) is positioned in mating vertical slots formed in the outer wall of the cam surface 37 and the inner wall of the latch 19 opposite the threads 21. Key 46 prevents the latch 19 from rotating with respect to the inner conduit 15 under any circumstances. Consequently, if the inner conduit 15 is rotated from the surface, the latch 19 will rotate with it, unscrewing the threads 21 from the threads 17. Once fully unscrewed, the inner conduit 15 may be pulled to the surface.

FIGS. **1*a* and 1*b* illustrate the remaining components of a subsea well tie-back connection. The subsea wellhead 47 includes a wellhead housing 49 that extends upwardly from the sea floor. A connector body 51 is adapted to be mounted to the wellhead housing 49. In the embodiment shown in FIGS. 1***a* and 1*b*, the connector body 51 is nonrotatably mounted by using spring loaded dogs 53. The dogs 53 engage grooves 55 located on the exterior of the wellhead housing 49. Dogs 53 ratchet into the grooves 55 while lowering. A backup segment 57 is located rearwardly of each dog 53 to prevent the dogs 53 from retracting due to upward tension being applied on the connector body 51. Grooves 59 are located rearwardly of the backup segments 57. If pin 61 is removed, connector body 51 can be pulled upwardly to align the grooves 59 with the backup segments 57 to allow retraction of the dogs 53 for removal of the connector body 51.

A large diameter conduit 63, typically 26 inch, is mounted to the connector body 51 and extends upwardly to the surface where it is supported. A seal 65 seals the connector body 51 to the wellhead housing 49.

A conduit 67, typically a 13 $\frac{3}{8}$ inch size, locates in the connector body 51. Conduit 67 extends to the surface and is secured in tension to the connector body 51 by means of a latch 69. Latch 69 engages threads 71 formed in connector body 51. Latch 69 is retained by a retainer ring 73. A key 75 prevents the latch 69 from rotating relative to the conduit 67. Latch 69 and retainer ring 73 are the same as the latch 19 and retainer ring 27 previously described. The conduit 67 is secured by the same method as previously described.

Figure 1A:
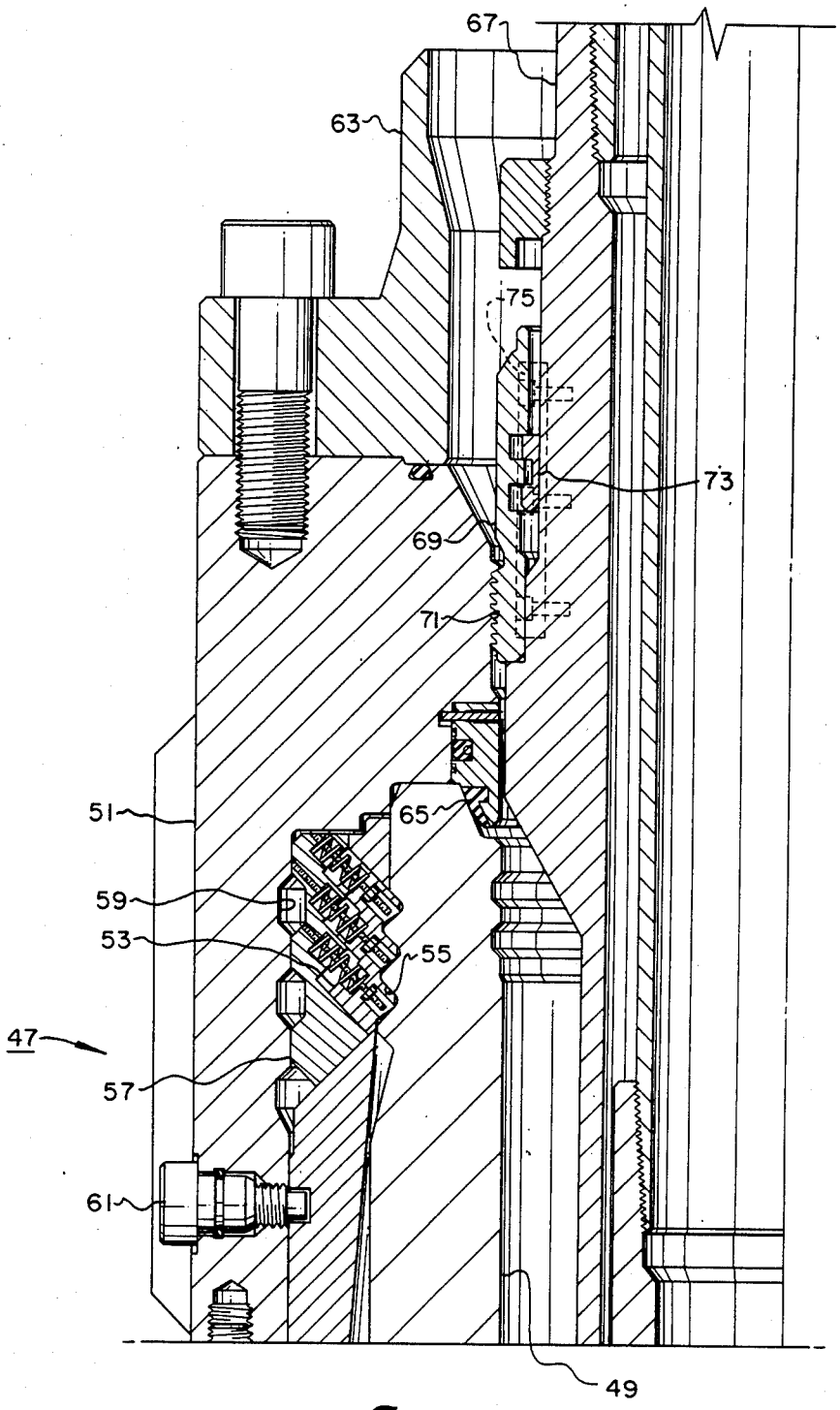
FIG. 1*a* is a cross-sectional view of the upper portion of a tie-back connection apparatus constructed in accordance with this invention.
Figure 1B:
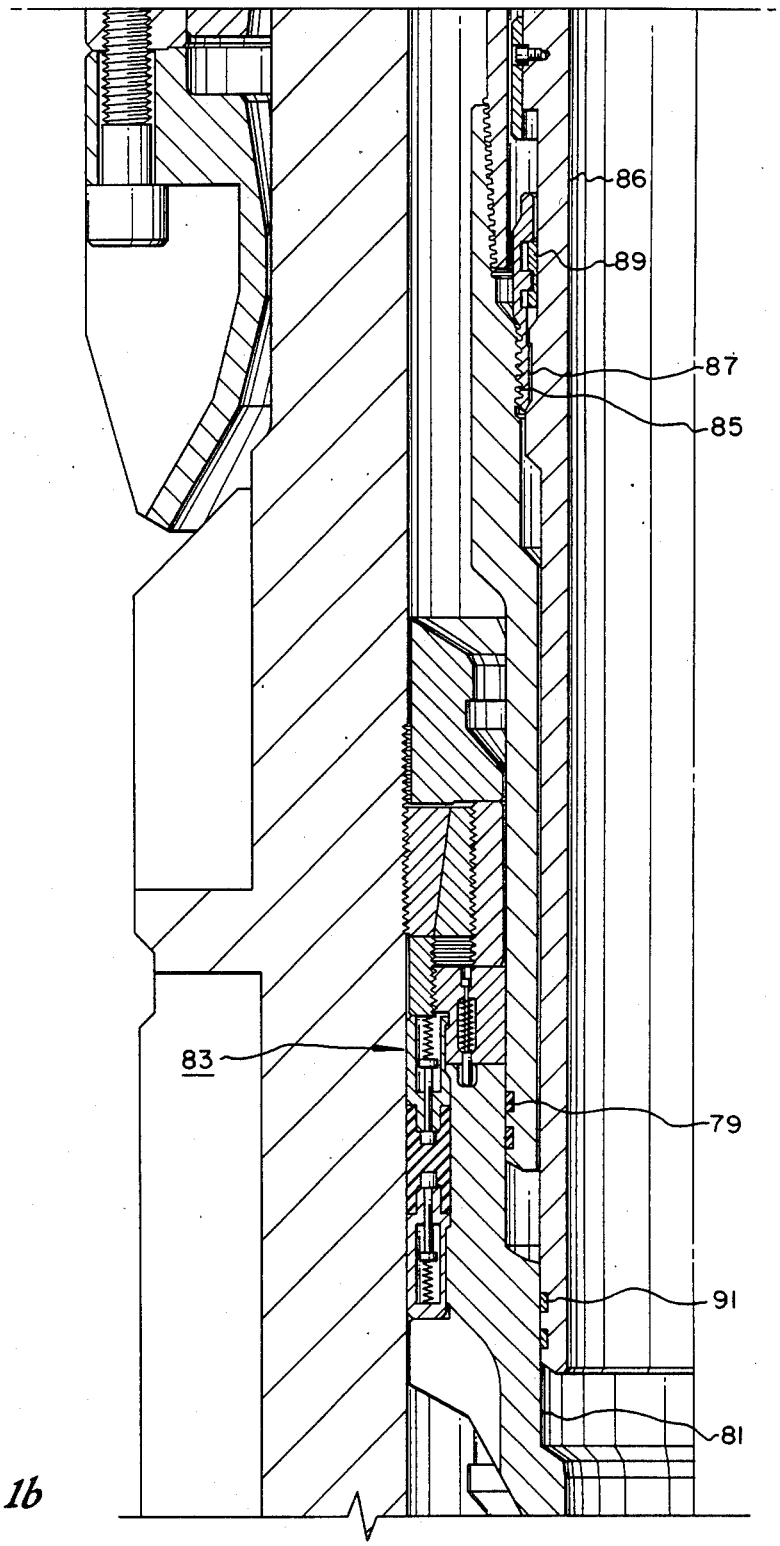
FIG. 1*b* is a cross-sectional view of the lower portion of the tie-back connection apparatus of FIG. 1*a*.

As shown in FIG. 1*b*, the lower end of the conduit 67 contains seals 79 which seal against a casing housing 81. Casing housing 81 is a part of a conventional casing hanger that mounts in the wellhead housing 49. A conventional seal section 83 seals between the wellhead housing 49 and the casing housing 81.

As shown in FIG. 1*b*, the conduit 67 has on its inner wall a set of threads 85. A smaller diameter conduit 86, normally 9 $\frac{5}{8}$ inch, extends downwardly from the surface to locate inside a smaller section of the casing housing 81. The conduit 86 is secured by a latch 87 to the threads 85. A retainer ring 89 prevents downward movement, while the latch 87 resists upward movement. Latch 87 and retainer ring 89 are the same as described in connection with latch 19 and retainer ring 27 in FIGS. 2 through 9. The lower end of the conduit 86 has seals 91 with seals inside the lower smaller diameter portion of the casing housing 81.

To secure the tie-back connection apparatus of FIGS. 1*a* and 1*b*, initially, the wellhead housing 49 will be in place. The casing housing 81 will be in place, with cement having been pumped through to secure the casing (not shown) which is mounted to the lower end of the casing housing 81. The seal section 83 will be set. Then the external tie-back connector is lowered in place. The connector body 51 is positioned on the wellhead housing 49, with the dogs 53 locking into the grooves 55. Conduit 63 is lowered into the connector body 51 until its lower end contacts the casing housing 81. The latch 69 will ratchet past the threads 71 while lowering. Then the conduit 67 is picked up, with the latch 69 engaging the threads 71 as previously described in connection with FIGS. 2 through 9.

Then the conduit 86 is lowered into the conduit 67 until its lower end strikes the shoulder in the casing housing 81. The latch 87 will ratchet past the threads 85 while lowering. Then conduit 86 is picked up with the latch 87 engaging the threads 86 as previously described in connection with FIGS. 2 through 9. For later removal, conduits 67 and 86 can be rotated to unscrew the latches 69 and 87 from the respective threads 71 and 85.

The invention has significant advantages. The latch mechanisms allow the tie-back connection to be easily accomplished without the need to rotate the pipe. Complex running tools are not required to actuate any members. Removal is readily accomplished by rotating the conduits.

While the invention has been shown in only one of its forms, it should be apparent to those skilled in the art that it is not so limited, but is susceptible to various changes without departing from the scope of the invention.

I claim:

1. A tie-back connection apparatus for securing the lower end of an inner conduit into an outer conduit of a subsea wellhead, the inner conduit extending upwardly from the wellhead and being held in tension, the apparatus comprising in combination:

a set of threads formed on an inner wall of the outer conduit;

an annular latch carried by the inner conduit, the latch having a set of threads on its exterior for engaging the threads in the outer conduit, the threads of the latch being resiliently contractible in a radial direction;

means on the inner conduit for allowing the latch threads to deflect inwardly to slidingly ratchet past the outer conduit threads while the inner conduit is in a lower position relative to the latch and as the inner conduit is lowered without rotation into the outer conduit;

means for preventing the latch threads from deflecting inwardly when the inner conduit is subsequently moved upwardly relative to the latch to an upper position, for securing the inner conduit to the outer conduit against upward movement; and retaining means cooperating with the latch and the inner conduit for preventing after the inner conduit has moved to the upper position subsequent downward movement of the inner conduit relative to the latch and outer conduit, and for transmitting a downward load on the inner conduit through the retaining means to the latch, and through the threads of the latch to the outer conduit;

the engaging threads allowing removal of the inner conduit from the outer conduit by rotation of the inner conduit.

2. A tie-back connection apparatus for securing the lower end of an inner conduit into an outer conduit of a subsea wellhead, the inner conduit extending upwardly from the wellhead and being held in tension, the apparatus comprising in combination:

a set of threads formed in the outer conduit;

an annular latch carried by the inner conduit, the latch being mounted to the inner conduit to allow sliding movement of the inner conduit relative to the latch between an upper position and a lower position, the latch being mounted nonrotatably to the inner conduit, the latch being a split ring that is resiliently contractible in a radial direction, the latch having a set of threads on its exterior which are adapted to engage the threads of the inner conduit;

cam means formed on the exterior of the inner conduit for allowing the latch threads to contract and slidingly ratchet past the outer conduit threads while the inner conduit is in the lower position and as the inner conduit and latch are lowered past the outer conduit without rotation, and for preventing the latch threads from deflecting inwardly while the inner conduit is moved upwardly relative to the latch to the upper position;

lower stop means on the inner conduit for contacting the latch while the inner conduit is in the upper position and the threads are in engagement, to secure the inner conduit to the outer conduit against upward movement;

a retainer ring carried between the latch and inner conduit and being resiliently movable in a radial direction;

upper stop means located between the latch and inner conduit for slidingly engaging the retainer ring as the inner conduit is moved to the upper position, causing the retainer ring to radially deflect, and having a shoulder for contacting the retainer ring when the inner conduit is in the upper position, to hold the inner conduit in the upper position to prevent downward movement of the inner conduit relative to the outer conduit; and seal means on the lower end of the inner conduit for sealing to the outer conduit;

the engaging threads allowing removal of the inner conduit from the outer conduit by rotation of the inner conduit and latch relative to the outer conduit.

3. A tie-back connection apparatus for securing the lower end of an inner conduit into an outer conduit of a subsea wellhead, the inner conduit extending outwardly from the wellhead and being held in tension, the apparatus comprising in combination:

a set of threads formed in the outer conduit;

an annular latch carried by the inner conduit, the latch being mounted to the inner conduit to allow sliding movement of the inner conduit relative to the latch between an upper position and a lower position, the latch being mounted nonrotatably to the inner conduit, the latch being a split ring that is resiliently contractible in a radial direction, the latch having a set of threads on its exterior which are adapted to engage the threads of the outer conduit;

cam means formed on the exterior of the inner conduit for allowing the latch threads to contract and slidingly ratchet past the outer conduit threads while the inner conduit is in the lower position and as the inner conduit and latch are lowered past the outer conduit without rotation, and for preventing the latch threads from deflecting inwardly while the inner conduit is moved upwardly relative to the latch to the upper position;

lower stop means on the inner conduit for contacting the latch while the inner conduit is in the upper position and the threads are in engagement, to secure the inner conduit to the outer conduit against upward movement;

a split retainer ring carried on the interior of the latch between the latch and the inner conduit;

upper stop means located on the inner conduit for slidingly engaging the retainer ring as the inner conduit is moved to the upper position, deflecting the retainer ring outwardly, the upper stop means having a lower shoulder for contacting the upper edge of the retainer ring once the inner conduit is in the upper position, to prevent downward movement of the inner conduit relative to the outer conduit; and seal means on the lower end of the inner conduit for sealing to the outer conduit;

the engaging threads allowing removal of the inner conduit from the outer conduit by rotation of the inner conduit and latch relative to the outer conduit.

* * * * *